US009284831B2

(12) United States Patent
Tomter et al.

(10) Patent No.: US 9,284,831 B2
(45) Date of Patent: Mar. 15, 2016

(54) APPARATUS AND METHOD FOR OPERATING A SUBSEA COMPRESSION SYSTEM

(75) Inventors: Ole Petter Tomter, Asker (NO); Jorgen Wessel, Asker (NO)

(73) Assignee: Vetco Gray Scandinavia AS, Sandvika (NO)

( * ) Notice: Subject to any disclaimer, the term of this patent is extended or adjusted under 35 U.S.C. 154(b) by 0 days.

(21) Appl. No.: 14/123,034

(22) PCT Filed: Jun. 1, 2012

(86) PCT No.: PCT/IB2012/001063

§ 371 (c)(1),
(2), (4) Date: Apr. 29, 2014

(87) PCT Pub. No.: WO2012/164382

PCT Pub. Date: Dec. 6, 2012

(65) Prior Publication Data

US 2014/0223894 A1 Aug. 14, 2014

(30) Foreign Application Priority Data

Jun. 1, 2011 (NO) ..... 20110802

(51) Int. Cl.

| | |
|---|---|
| ***F25J 1/00*** | (2006.01) |
| ***F25J 3/00*** | (2006.01) |
| ***E21B 43/36*** | (2006.01) |
| ***E21B 43/34*** | (2006.01) |

(52) U.S. Cl.

CPC ..... *E21B 43/36* (2013.01); *E21B 43/34* (2013.01)

(58) Field of Classification Search

None

See application file for complete search history.

(56) References Cited

U.S. PATENT DOCUMENTS 4,645,522 A * 2/1987 Dobrotwir ..... B01D 1/2881 62/619
4,970,867 A * 11/1990 Herron ..... F25J 1/0022 62/335
7,814,975 B2 * 10/2010 Hagen ..... E21B 43/24 166/257

(Continued)

FOREIGN PATENT DOCUMENTS

CN 101330953 A 12/2008
CN 101498229 A 8/2009

(Continued)

OTHER PUBLICATIONS

International Search Report and Written Opinion issued in connection with PCT Application PCT/IB2012/001063 dated Sep. 20, 2012.

(Continued)

*Primary Examiner* — Matthew R Buck
*Assistant Examiner* — Douglas S Wood
(74) *Attorney, Agent, or Firm* — GE Global Patent Operation

(57) ABSTRACT

Apparatus and method for operating a subsea compression system. The subsea compression system comprising a separator, a compressor and a pump, wherein the compressor is operable for compression and discharge of gas that is separated from a well stream fed into the separator, and the pump is operable for pumping liquid that is separated from the well stream. The compressed gas is recycled from the compressor discharge side to the compressor intake side via a turbo-expander unit which is drivingly connected to the pump, the pump operable in response to circulation of compressed gas from the compressor discharge side to the compressor intake side.

18 Claims, 2 Drawing Sheets

(56) References Cited

U.S. PATENT DOCUMENTS

Figure 1:
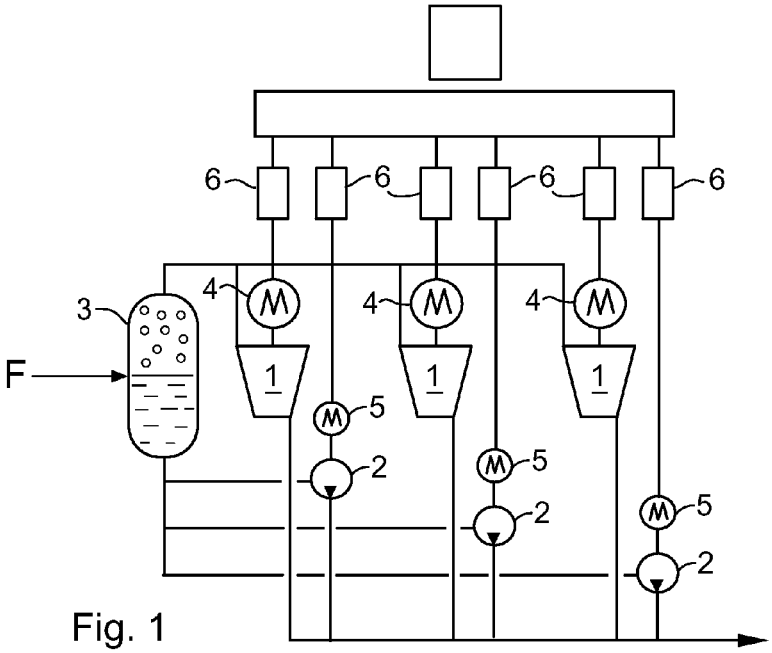

| | | | | |
|---|---|---|---|---|
| 8,277,547 | B2 | 10/2012 | Folkvang | |
| 8,414,250 | B2 * | 4/2013 | Hansen | F04D 25/02 415/124.1 |
| 8,555,672 | B2 * | 10/2013 | Turner | F25J 1/002 62/613 |
| 2007/0029091 | A1 | 2/2007 | Stinessen et al. | |
| 2007/0237696 | A1 | 10/2007 | Payton | |
| 2009/0199590 | A1 | 8/2009 | Adler et al. | |
| 2009/0200035 | A1 | 8/2009 | Bjerkreim et al. | |

FOREIGN PATENT DOCUMENTS

| | | | |
|---|---|---|---|
| EP | 0661425 | A1 | 7/1995 |
| WO | WO2007103248 | A2 | 9/2007 |

OTHER PUBLICATIONS

Norwegian Search Report and Office Action dated Dec. 22, 2011.

European Search Report and Written Opinion issued in connection with corresponding EP Application No. 12793714.2-1610 dated Jun. 11, 2015.

Unofficial English Translation of Chinese Office Action issued in connection with corresponding CN Application No. 201280026332.6 on Aug. 24, 2015.

* cited by examiner

APPARATUS AND METHOD FOR OPERATING A SUBSEA COMPRESSION SYSTEM

TECHNICAL FIELD OF THE INVENTION

The present invention relates to a compression system for well stream boosting by compression of gas and pumping of liquid in subsea hydrocarbon production. More precisely, the present invention refers to apparatuses and methods for operating a subsea compression system configured for this purpose.

BACKGROUND AND PRIOR ART

Offshore gas production involves installations on the seabed which are controlled and powered from a land-based or sea-based terminal or host facility. Well fluid is transported via pipelines from a subsea production system to a receiving terminal to be further processed before the products are supplied to market. In the initial phases of production, the fluid reservoir pressure is usually sufficient for feeding the hydrocarbon fluids through the pipeline. Later in production, or in the case of very long distance between the well fluid reservoir and the receiving terminal, boosting of fluid pressure and flow may be required in one or more compression systems along the feed line in order to maintain flow rate and production level.

Compressors used in subsea compression systems are adapted to process wet gas containing a certain ratio of liquid. Above such a ratio, liquid pumps will be required. In the compression system, well fluid containing gas and liquid enters a separator or scrubber in which liquid is separated from the well stream and fed to the pump, providing predictable operating points for both the compressor and the pump with respect to liquid volume fraction or level. The pump is operated to pump the liquid downstream, typically by injecting the liquid into the compressed gas that is discharged from the compressor, whereby a re-mixed multiphase well fluid leaves the compression system at a raised pressure level and flow. Nevertheless, the subsea compression system may optionally be arranged for discharge of boosted gas and liquid flows via separate export lines.

Conventionally, each compressor and pump is typically driven by a dedicated electrical motor respectively which is supplied operating and control power via an umbilical connecting the compression system with its host facility. Each compressor or pump motor in the compression system requires for its operation an individual setup of power and control gear for a variable speed drive, such as subsea switchgear, wet-mate electrical connectors, high voltage electrical jumpers and electrical control system components, cooling and lubrication circuits including valves and flow and pressure control, etc.

SUMMARY OF THE INVENTION

The present invention aims to reduce the number of components and power required in a subsea compression system configured for boosting a well stream containing gas and liquid.

The object is met in a subsea compression system comprising a separator, a compressor and a pump, wherein the compressor is operable for compression and discharge of gas that is separated from a bi-phase well stream fed into the separator, and the pump is operable for pumping liquid that is separated from the well stream.

The method for operating the subsea compression system comprises: arranging the compressor in a gas feed line from the separator; providing a gas return line connecting a discharge side of the compressor with an intake side of the compressor; arranging a turbo expander unit in flow connection with the gas return line; arranging the pump in a liquid feed line from the separator; connecting the turbo expander unit drivingly to the liquid pump; and operating the pump in response to circulation of compressed gas from the compressor discharge side to the compressor intake side.

A subsea compression system according to the present invention correspondingly comprises a compressor, a pump and a separator, wherein the compressor is operable for compressing gas and the pump is operable for pressurizing liquid that is separated, in the separator, from a bi-phase well stream received in the compression system, and further wherein gas is fed from the separator to the compressor via a gas feed line and discharged from the compressor in a compressed state, and liquid is drawn from the separator to the pump via a liquid feed line and discharged from the pump at a pressurized state. A gas return line is arranged connecting a discharge side of the compressor with an intake side of the compressor; a turbo expander unit is arranged in flow connection with the gas return line; the turbo expander unit is drivingly connected with the pump, and the pump is operable in response to circulation of compressed gas from the compressor discharge side to the compressor intake side.

Thus, the dedicated pump motor and associated components such as power supply components, operation control, lubrication and cooling equipment etc., can be omitted which substantially reduces cost and complexity of the subsea compression system.

The turbo-expander unit is a centrifugal or axial flow turbine wherein compressed, high-pressure gas is expanded and the energy in the expanding gas is released for driving an expansion turbine or rotor in the turbo-expander unit.

In the present invention, the expansion turbine has an outgoing shaft which is drivingly connected to a pump wheel/rotor of a centrifugal pump or a positive displacement pump. The pump and turbo-expander unit may be connected directly, or indirectly via a reduction gear or a speed reduction device, e.g., inserted between the turbo-expander unit and the pump.

The turbo-expander unit is preferably included in a gas feed loop including a gas feed line connecting the compressor discharge and intake sides. The pressure of the expanded gas exiting the turbo-expander unit may be kept above the gas pressure on the intake side of the compressor for recycling the gas to the gas flow upstream the compressor. Alternatively, the expanded gas may be returned to the upstream gas flow by means of an ejector driven by the gas flow on the compressor intake side.

Thus basically, the intake to the turbo-expander unit is connected to a compressed-gas discharge line between the compressor outlet and a liquid injection point on the compressed-gas discharge line, and the outlet of the turbo-expander unit is over a flow control valve connectable to a fluid line feeding wet gas to the compressor, or alternatively connectable to the well-stream flow upstream of the separator.

The turbo-expander unit and pump are intermittently driven and controlled and regulated by the flow control valve, dedicated for this purpose and actuated in response to a detected liquid volume fraction in the separator, or in response to a detected liquid volume fraction in the well-stream that is supplied and fed to the separator.

In case that the pump used is unable to run on gas purely, an outlet on the discharge side of the pump may be connectable to the separator for re-circulation of liquid via a flow control valve arranged in a liquid return loop, including a liquid return line, in order to avoid the risk of the pump running dry.

The pump may also be stopped by closing the flow control valve in the event of reaching a low liquid set point in the separator, or the pump may also have an external liquid service line typically supplying methanol or glycol which can be used for continuous and/or intermittent priming of the pump.

The flow circuit of the subsea compression system comprises a re-cycling loop by which gas can be returned from the compressor discharge side to the compressor intake side. An anti-surge recycling loop can be provided by the present invention by arranging the gas flow through the turbo-expander unit for operation of the turbo-expander unit and the pump in response to a detected surge condition in the compressor, while simultaneously controlling the liquid flow from the pump for either of re-circulation to the separator or injection into the compressor discharge line or export line.

Several sets of compressors and pumps may be arranged in the subsea compression system, each set comprising a compressed gas return loop, a liquid return loop and turbo expander unit, respectively.

Two or more compressors or compressor stages may be arranged in series. A turbo expander unit may be inserted in a compressed-gas return flow from a last compressor or a last compressor stage, respectively, to a first compressor or first compressor stage in the series.

An intercooler may further be installed between the compressors or compressor stages arranged in series.

Further advantages, advantageous features and embodiments of the invention will appear from the dependent claims and from the following detailed description of preferred embodiments.

SHORT DESCRIPTION OF THE DRAWINGS

Figure 2:
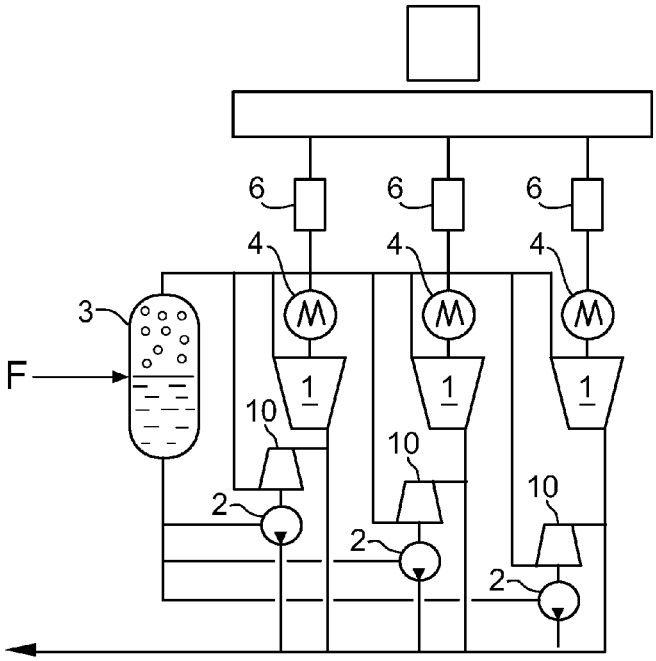
Figure 3:
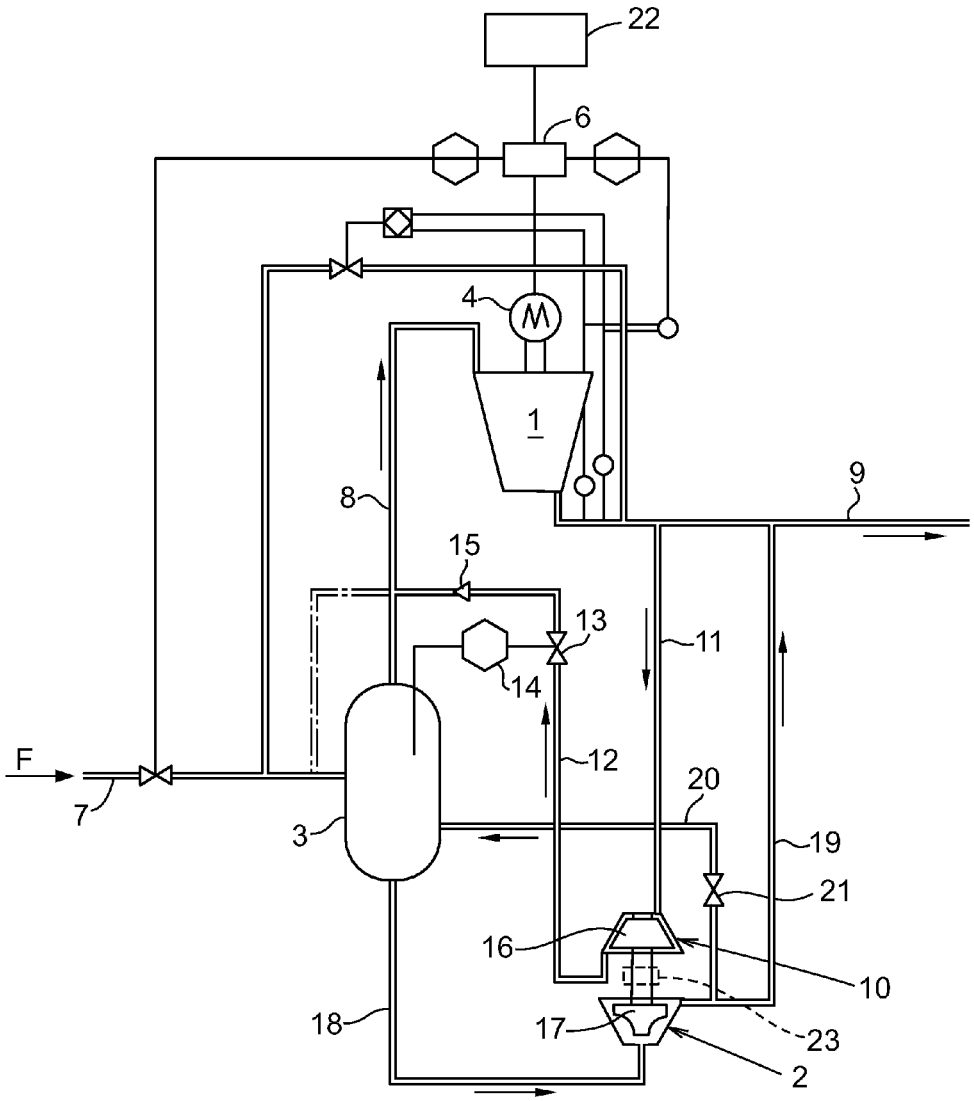

The invention will be further explained below with reference made to the accompanying, schematic drawings. In the drawings, FIG. 1 is a diagram illustrating schematically the setup of a prior art subsea compression system;

FIG. 2 is a diagram corresponding to FIG. 1, illustrating the setup of a subsea compression system according to the present invention, and FIG. 3 is a simplified diagram illustrating an implementation of the present invention.

DETAILED DESCRIPTION OF PREFERRED EMBODIMENTS

An overview of the main modules and flow circuits of a subsea compression system for well stream boosting is illustrated schematically in the diagram of FIG. 1. The subsea compression system receives bi-phase or multi-phase well fluid from at least one subsea production system and feeds boosted well fluid F into one or more export pipe lines for further transport to a receiving terminal or host facility. The subsea compression system comprises a compressor module including one or more compressors 1, a pump module including at least one pump 2, and a separator/scrubber module including a separator 3. The separator 3 is designed for liquid/gas separation and may additionally be structured for dissolving liquid slugs, for hydrate prevention and for sorting out solid particles entrained in the well stream, for gas scrubbing etc., so that compressible gas (wet gas) is delivered to the compressor intake. The compressor(s) 1 is designed for raising the pressure of the gas and discharging the gas at an elevated pressure into the export pipeline. The pump(s) 2 is designed for injecting the excess liquid, at an elevated pressure, to the gas flow discharged from the compressor.

High voltage power, low voltage power, hydraulic, control and utilities are supplied from the host facility via an umbilical connected to the subsea compression system. Utility and control power is distributed to consumers on the subsea compression system via transformers, high voltage cables and wet-mate electrical connectors, switchgear, electrical jumpers, circuit breaker modules, etc. Since the compressor(s) and pump(s) are individually driven by dedicated variable speed drive (VSD) electrical motors 4 and 5, respectively, utility and control power equipment need to be individually installed for each motor. In the drawings, the dedicated utility and control power equipment is schematically represented through VSD-blocks 6.

In addition, each motor requires separate flexible couplings, guiding and landing devices, valves and fluid lines for cooling, lubrication and barrier pressure, in the subsea compression system.

FIG. 2 is an overview of a subsea compression system which is setup in utilization of the present invention. A noticeable difference in the architecture of FIG. 2 is the significantly reduced number of VSD-blocks 6, which can be reduced by 50% as the result of driving the pump(s) 2 with compressed gas discharged from the compressor(s), as taught by the present invention.

Naturally, the reduction in number of components required in the subsea compression system applies to all components that would otherwise have been involved in the operation of the omitted pump motor.

A subsea compression system laid out in accordance with a preferred embodiment of the present invention is illustrated schematically in FIG. 3.

Without explicitly being explained in detail with reference to FIG. 3, a fully equipped and operative subsea compression system typically comprises import and export well stream manifolds and valves, flow and pressure meters, recirculation lines and valves, anti-surge control circuit and valves, lubrication and barrier fluid circuits and valves, umbilical head end, transformers, coolers, sand trap etc., and other equipment which is conventionally found on a subsea compression system. For reasons of clarity, the detailed structure and organization of modules and units which are of subordinated significance in this connection have been excluded from FIG. 3.

In a subsea compression system implementing the invention, well fluid F is supplied to the subsea compression system via well-stream supply line 7 and fed into the separator 3, configured for separation of gas and liquid contained in the well-stream. Wet gas is delivered from the separator to the intake of compressor 1 via wet gas feed line 8.

Compressed gas is discharged from the compressor 1 via compressed-gas discharge line 9 to outgoing piping and export pipe lines (not shown). High-pressure gas is extracted from the compressor discharge line 9 and supplied via compressed gas feed line 11 to a turbo-expander unit 10. Expanded gas is discharged from the turbo-expander unit 10 and recycled to the intake side of the compressor via expanded gas return line 12, over a flow regulation valve 13. The flow regulation valve 13, which alternatively can be installed on the gas feed line 11 to the turbo-expander unit 10, is controllable in response to a liquid volume fraction in the separator detected by sensor means and applied in a subsea control unit 14 which controls the setting of the flow regulation valve 13. A one way valve 15 in the gas return line 12 prevents back flow into return gas line 12.

In alternative to returning the expanded gas from the turbo-expander unit 10 to the gas feed line 8 on the intake side of the compressor 1 as illustrated in continuous lines in FIG. 3, the expanded gas may be returned further upstream on the intake side of the compressor, such as to the separator or to the bi-phase well stream fed into the separator, as illustrated in FIG. 3 by dash-dot lines extending the gas return line 12 to the upstream side of the separator. The latter alternative may be advantageous, e.g., in a case where liquid is precipitated from the expanded gas on the discharge side of the turbo-expander unit 10.

The expansion turbine 16 in the turbo-expander unit 10 is drivingly connected to a pump wheel or rotor 17 in the liquid pump 2. In operation, the pump 2 draws liquid from the separator 3 via liquid feed line 18 for injection into the compressed-gas discharge line 9, via liquid injection line 19 which connects to the discharge line 9 at a liquid injection point. Re-cycling of liquid back to the separator 3 can be accomplished via liquid return loop 20 and flow control valve 21, connecting the separator with the liquid injection line 19 on the outlet side of the pump.

The pump may also be stopped by closing the flow control valve in the event of reaching a low liquid set point in the separator, or the pump may also have an external liquid service line typically supplying methanol or glycol which can be used for continuous and/or intermittent priming of the pump.

Utility and control power is supplied to the compressor motor 4 via VSD-block 6 and umbilical head end block 22 representing the necessary high and low voltage circuits, wet mate connectors, switchgear, circuit breakers, etc.

The compressor(s) used in the subsea compression system is designed for a substantial elevation of the gas pressure, such as from about 40 bar at compressor intake to about 120 bar at compressor discharge, e.g. Heavy duty centrifugal wet gas compressors are generally used in this connection, typically operating at a power range of one or several tens of megawatt and at rotational speeds in the order of 8-12 000 rev per min.

The pump(s) used in the subsea compression system is designed for boosting the liquid stream up to a pressure required for introduction into the gas discharged from the compressor. Fixed displacement pumps are useful in this connection, operating at a power range of hundreds of kilowatt and at rotational speeds of about 1500-4000 rev per min.

Thus in most compressor/pump combinations a speed reduction ratio of about 4-5:1 might be desired and appropriate. Compressors, fixed displacement pumps or centrifugal pumps rotating at other operational speeds may however alternatively be used, requiring none or other speed reduction ratios. Nevertheless, the present invention provides great freedom in the choice of pump/compressor combination since the drive gas flow and resulting output torque and rotation can be controlled through the flow regulation valve 13. Alternatively a speed reduction or regulation device, indicated through a symbolic representation 23 in FIG. 3, such as a hydrodynamic torque converter or an electrical hysteresis clutch, e.g., can be inserted between the turbo-expander unit and the pump and controlled between zero and 100% lockup between driving and driven components, depending on the output torque required.

Naturally, the invention is not limited to the in-line, co-axial assembly of turbo-expander unit and pump which is schematically illustrated in the drawings. Instead, the pump and turbo-expander unit may alternatively be arranged on parallel longitudinal axes, or even on crossing axes, with intermeshing gears or bevel gears transmitting torque and rotation from the expansion turbine to the pump rotor.

The invention is not restricted to the embodiments described above. On the contrary, many possibilities to modifications thereof may appear to a skilled person from the teachings provided herein, without departing from the basic idea of the invention. Such modification may include, for example, a plurality of compressors and pumps arranged in the subsea compression system. Another modification foresees that two or more compressors or compressor stages are arranged in a series. In such embodiment, an intercooler may be installed between the compressors or compressor stages arranged in series. It is also conceivable to arrange an intermediate tapping and extraction of compressed gas between the compressors or compressor stages arranged in series, for supply to the turbo-expander unit.

These and other conceivable modifications, providing equal effects and advantages, are foreseen by the inventors, and shall be deemed included in the scope of the appended claims.

What is claimed is:

1. A method of operating a subsea compression system comprising a compressor, a pump and a separator, the compressor operable for compressing gas and the pump operable for pressurizing liquid that is separated, in the separator, from a bi-phase well stream received in the compression system, the method comprising:

arranging the compressor in a gas feed line from the separator;

providing a gas return line connecting a discharge side of the compressor with an intake side of the compressor;

arranging a turbo-expander unit in flow connection with the gas return line;

arranging the pump in a liquid feed line from the separator;

connecting the turbo-expander unit drivingly to the pump; and operating the pump using the turbo-expander unit being driven b compressed gas circulated from the compressor discharge side to the compressor intake side.

2. The method of claim 1, wherein the pump is arranged in flow connection with a liquid return line connecting a discharge side of the pump with the separator.

3. The method of claim 1, wherein the turbo-expander unit and pump are operated in response to a detected liquid volume fraction in the separator.

4. The method of claim 1, wherein the turbo-expander unit and pump are operated in response to a detected surge condition in the compressor.

5. The method of claim 1, wherein the rotational speed of the turbo-expander unit is reduced in a reduction gear or speed reduction device inserted between the turbo-expander unit and the pump.

6. The method of claim 1, wherein several sets of compressors and pumps are arranged in the subsea compression system, each set comprising a compressed gas return loop, a liquid return loop and a turbo-expander unit.

7. The method of claim 1, wherein two or more compressors or compressor stages are arranged in series, a turbo-expander unit inserted in a compressed gas return flow from a last compressor or a last compressor stage to a first compressor or first compressor stage in the series.

8. A subsea compression system comprising:

a compressor;

a pump;

a separator, wherein the compressor is operable for compressing gas and the pump is operable for pressurizing liquid that is separated, in the separator, from a bi-phase well stream received in the compression system, and wherein gas is fed from the separator to the compressor via a gas feed line and discharged from the compressor in a compressed state, and liquid is drawn from the separator to the pump via a liquid feed line and discharged from the pump at a pressurized state;

a gas return line connecting a discharge side of the compressor with an intake side of the compressor; and a turbo-expander unit is arranged in flow connection with the gas return line, wherein the turbo-expander unit is drivingly connected with the pump, wherein the pump is operated using the turbo-expander unit being driven by compressed gas circulated from the compressor discharge side to the compressor intake side.

9. The compression system of claim 8, wherein an intake side of the turbo-expander unit is connected to a compressed gas discharge line between a compressor outlet and a liquid injection point on the compressed gas discharge line, wherein the outlet of the turbo-expander unit is in communication with a flow control valve connectable to a fluid line feeding wet gas to the compressor.

10. The compression system of claim 9, wherein the flow control valve is actuated in response to a detected liquid volume fraction in the separator.

11. The compression system of claim 8, wherein an outlet of the pump is connectable to the separator via a flow control valve arranged in a liquid return loop.

12. The compression system of claim 8, wherein the compressed gas flow through the turbo-expander unit is controllable in response to a detected surge condition in the compressor.

13. The compression system of claim 8, wherein the pump is a positive displacement pump.

14. The compression system of claim 8, wherein a reduction gear or speed reduction device is inserted between the turbo-expander unit and the pump.

15. The compression system of claim 8, wherein a plurality of compressors and pumps are arranged in the subsea compression system.

16. The compression system of claim 8, wherein two or more compressors or compressor stages are arranged in a series.

17. The compression system of claim 16, wherein an intercooler is installed between the compressors or compressor stages arranged in series.

18. The compressor system of claim 16, wherein the compressed gas is extracted between the compressors or compressor stages arranged in series and supplied to the turbo-expander unit.

* * * * *